US005433322A

United States Patent [19]

Williams

[11] Patent Number: 5,433,322

[45] Date of Patent: Jul. 18, 1995

[54] SCAFFOLD STACKING DEVICE WITH A CLEAT AND CABLE

[76] Inventor: Joe W. Williams, P.O. Box 412, Walker, La. 70785

[21] Appl. No.: 213,846

[22] Filed: Mar. 15, 1994

[51] Int. Cl.[6] ..... B65D 85/20; B65D 85/62; B65D 21/02; A47F 7/00

[52] U.S. Cl. ..... 206/443; 206/509; 206/597; 211/59.4; 211/60.1; 211/194

[58] Field of Search ..... 206/443, 386, 597, 499, 206/509, 511, 446; 211/59.4, 60.1, 194; 108/53.1, 55.1

[56] References Cited

U.S. PATENT DOCUMENTS

| | | | |
|---|---|---|---|
| 3,590,752 | 7/1971 | De Pew | 211/60.1 X |
| 3,945,497 | 3/1976 | Greenberg | 211/194 X |
| 4,195,732 | 4/1980 | Bell | 206/386 X |
| 4,901,870 | 2/1990 | Wright et al. | 211/59.4 |

FOREIGN PATENT DOCUMENTS

| | | | |
|---|---|---|---|
| 0586065 | 12/1977 | U.S.S.R. | 206/446 |

*Primary Examiner*—Bryon P. Gehman
*Attorney, Agent, or Firm*—Robert C. Tucker; William David Kiesel

[57] ABSTRACT

A scaffold stacking device of unitary construction is provided, comprising a generally elongated block member having a top side and a bottom side; a plurality of semi-circular recesses formed along the top and bottom sides, wherein each of the recesses is sized to receive a scaffold member; and vertical posts attached to the ends of the block member for mating with vertical bores in other identical stacking devices. Multiple stacking devices are secured to one another by passing a cable through cleats attached to the stacking devices. The resulting configuration allows the scaffold members to be easily and quickly counted, and the scaffold members can be transported to and from construction sites safely and without wear or damage from contact with other scaffold equipment.

8 Claims, 2 Drawing Sheets

SCAFFOLD STACKING DEVICE WITH A CLEAT AND CABLE

BACKGROUND OF THE INVENTION

I. Field of the Invention

The present invention relates generally to scaffold equipment, and more particularly to devices for stacking and transporting scaffold equipment, namely the horizontal and vertical scaffold members used in scaffold construction.

II. Description of the Prior Art

In the scaffold construction industry, scaffold equipment is typically delivered to and from the construction site by way of flat-bed trucks. This equipment is most often comprised of vertical and horizontal scaffold members, scaffold boards, and various connection hardware. The horizontal scaffold members are generally elongated sections of aluminum tubing having ends which allow for the attachment of these members to one another as needed. The vertical scaffold members are similarly shaped, but each one typically includes a number ring-like structures or cups spaced along its length to which connections can be made with the horizontal scaffold members.

Whether the scaffold construction company owns or rents the scaffold equipment to be used at the construction site, it is critically important that the scaffold equipment be in good condition to ensure a safe scaffold structure for construction workers. It is also important to know exactly how many of each piece of equipment is on the truck, both at the time of shipment from the source and at the time of delivery to the site. Missing or damaged scaffold equipment almost always translates into lost time and money for scaffold company. The most popular method of delivering scaffold equipment to and from the site, particularly the horizontal and vertical members, involves stacking the members between guide posts on a flat-bed truck and tying them down with a rope or cable.

There are several problems with this method. First, it is exceedingly difficult to obtain an accurate count of how many of each piece is on the delivery truck, because the members are not uniformly stacked between the guide posts. Second, this method necessarily requires that each member contact the neighboring members in the stack, resulting in wear and damage to the scaffold equipment over time due to the weight of surrounding members, rattling during transportation, and galvanic corrosion at the points of contact. This problem is especially costly for vertical members, because the ring-like structures or cups are more easily damaged. If these cups are worn to such an extent that connections are hard to make or unreliable, safety is sacrificed and the scaffold construction company may be subject to citations by regulatory authorities, such as OSHA.

What is needed, therefore, is a device for stacking and transporting horizontal and vertical scaffold members that (1) allows quick and easy counting of scaffold members at any time, and (2) prevents damage and wear to both horizontal and vertical scaffold members by keeping the members separate from one another and eliminating the possibility of rattling and corrosion during transportation.

SUMMARY OF THE INVENTION

It is therefore an object of this invention to provide a scaffold stacking device which prevents wear and damage to horizontal and vertical scaffold members.

It is also an object of this invention to provide a scaffold stacking device which allows quick and easy counting of scaffold members at any time during transportation.

It is a further object of this invention to provide a scaffold stacking device which is lightweight, inexpensive to manufacture, and easy to use.

These and other objects and advantages of the present invention will no doubt become apparent to those skilled in the art after having read the following description of the preferred embodiment which are contained in and illustrated by the various drawing figures.

Therefore, in a preferred embodiment, a scaffold stacking device for holding scaffold members is provided, comprising a block member having a top side and a bottom side; a plurality of recesses formed along said top side, wherein each of said recesses is sized to receive one of said scaffold members; and means attached to said block member for stackably connecting said scaffold stacking device to a second scaffold stacking device.

DETAILED DESCRIPTION OF THE PREFERRED EMBODIMENT

Figure 1:
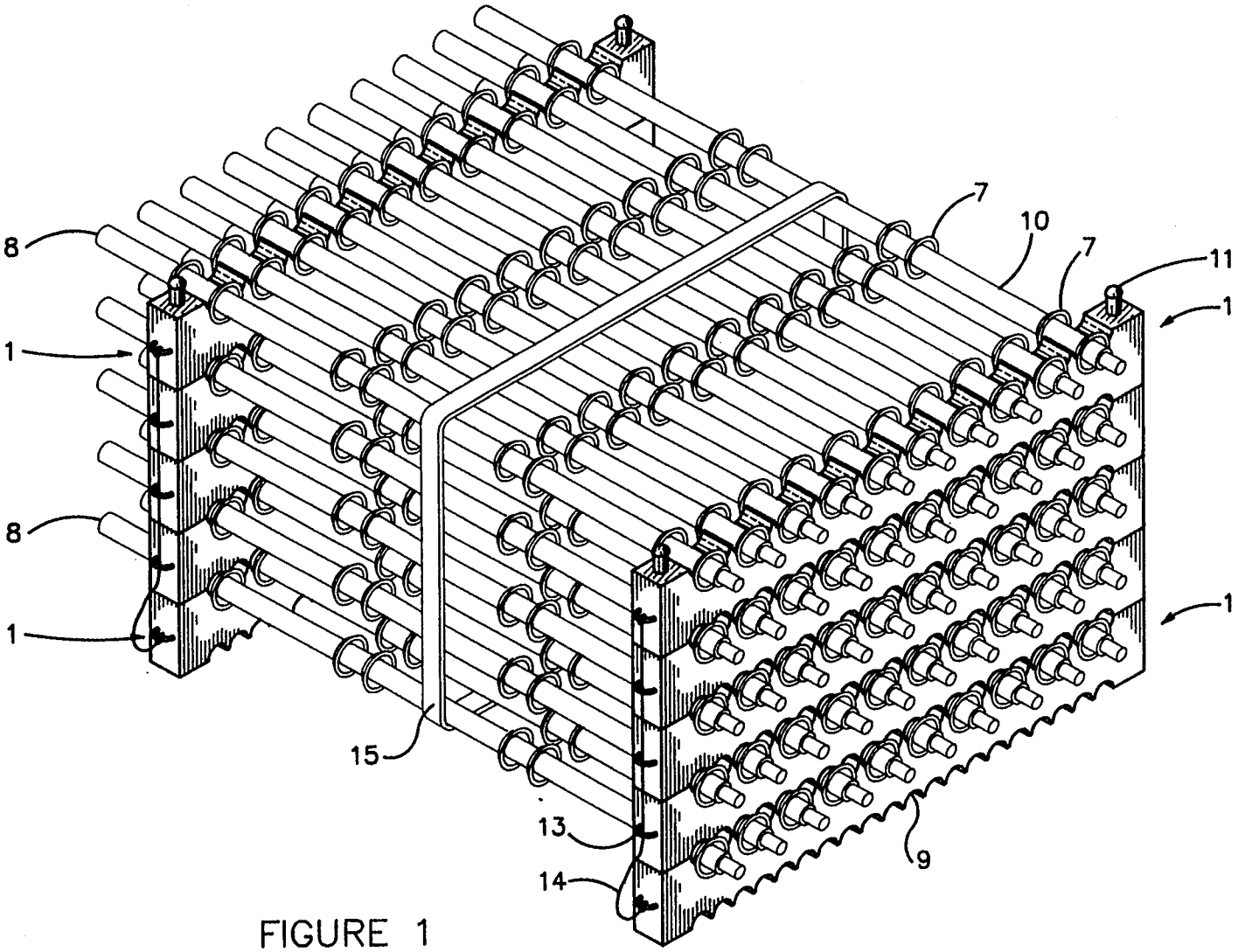
FIG. 1 is a perspective view of a preferred embodiment of the invention showing how vertical scaffold members may be stacked with multiple stacking elements.

In the drawings many details pertaining to fabrication and maintenance utility well established in the machine construction art and not bearing upon points of novelty are omitted in the interest of descriptive clarity and efficiency. Such details may include threaded connections, lockrings, shear pins, weld lines and the like. The spreading use of electron beam welding eliminates many such features and leaves no visible distinctive lines. Various and common fastening hardware which are essential to overall function, but which are largely matters of designer's choice, are not claimed and, hence, not shown.

Figure 2:
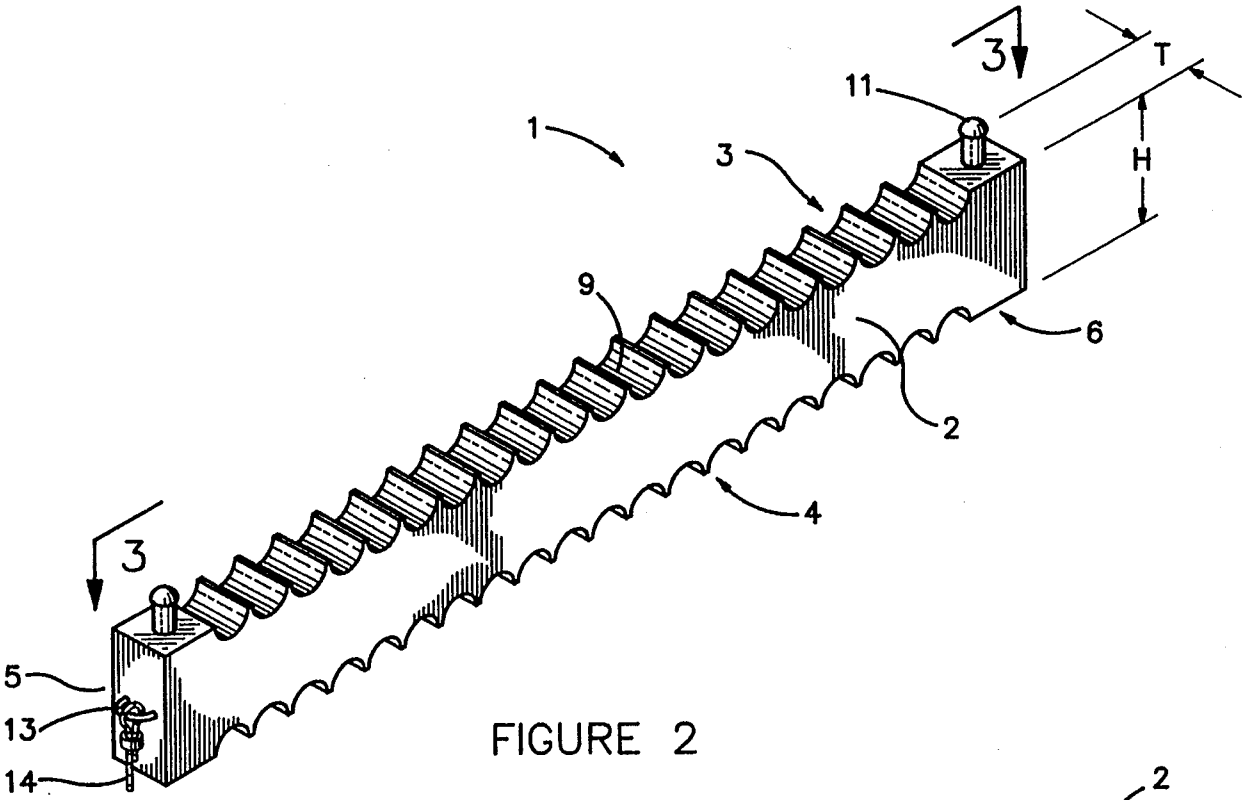
FIG. 2 is a perspective view of the invention of FIG. 1 showing the features of only one stacking element.
Figure 3:
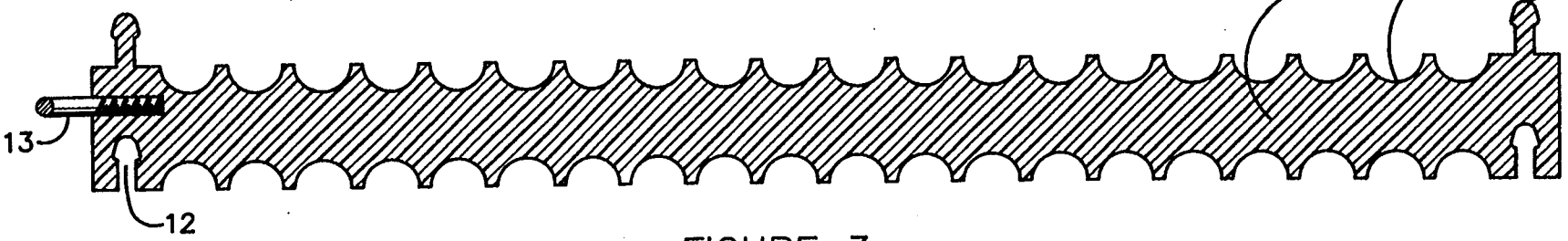
FIG. 3 is a sectional view of the stacking element of FIG. 2.

Turning now to the drawings, FIG. 2 shows a preferred embodiment of a stacking element 1 used in the present invention for enabling the stacking and transportation of both vertical scaffold members 8 and horizontal scaffold members (not shown). Most horizontal scaffold members are simply comprised of an aluminum or steel tubing and may include end connectors having features no larger than the diameter of the tubing itself. They also lack the ring-like cups 7 of their vertical counterparts. Thus, while the invention is portrayed in FIG. 1 as retaining only vertical scaffold members 8, it will be understood from the ensuing description how horizontal scaffold members are stacked and transported as well. Stacking element 1 generally comprises an elongated block member 2, preferably of unitary construction, having a top side 3, a bottom side 4, and opposed ends 5,6. Block member 2 may be constructed of virtually any material which imparts a rigid quality to stacking element 1, but a moldable, durable plastic is preferred for its ease of manufacture and toughness under weight and repeated stress. For reasons which will be more fully explained herein, block member 2 has a thickness T preferably less than or equal to the distance between the pairs of ring-like cups 7 on the vertical scaffold members 8, as well as a height H such that cups 7 from stacked members do not interfere with one another.

Both top side 3 and bottom side 4 include a plurality of equally spaced scallops or recesses 9 formed into block member 2. Preferably, recesses 9 are semi-circular in shape and have a radius of one inch (1") to fully contact the two-inch (2") outside diameter of the tube portion 10 on both vertical scaffold members 8 and horizontal scaffold members. The spacing between recesses 9 should be small enough to provide the minimum distance between any two scaffold members without allowing them to touch one another, thus allowing for greatest space efficiency. Thus, for scaffold members having a tube portion 10 outside diameter of two inches (2"), an appropriate spacing between recesses 9 would be about two and one-quarter inches (2¼") between centers. This spacing would allow horizontal scaffold members to be placed side-by-side with a clearance between them of only one-quarter inch (¼"). Vertical scaffold members 8, having cup diameters typically four inches (4") or less, would be placed in alternating recesses 9, leaving one vacant recess 9 between each vertical scaffold member 8 as clearly depicted in FIG. 1.

The thickness T of block member 2 is preferably three inches (3") or less to fit between the cups 7 on vertical scaffold members 8, as well as to keep the stacking element 1 as lightweight as possible. Given the previously described preferred dimensions, height H should be no less than four inches (4"), and is preferably about six inches (6") high, to prevent any interference between cups 7 in a vertical direction. It is also preferred that the depth of each recess 9 be about one inch (1") for tube portions 10 having an outside diameter of two inches (2"). For other scaffold sizes, the depth of recess 9 should be equal to the radius of the relevant tube portion 10. These dimensions advantageously create a 360° contact between each scaffold member and the stacking elements 1 to prevent rattling during transportation. Although FIG. 1 depicts the invention as including enough recesses 9 for twenty (20) scaffold members laid side-by-side, it will be understood to those of ordinary skill that any number of recesses 9 may be formed into block member 2 as long as the transporting vehicle is wide enough to accommodate the size of stacking elements 1.

Each stacking element 1 is also provided with a pair of vertical posts 11 extending from top side 3, which can be formed as a part of the molding process for block member 2. Posts 11 are sized to mate with a corresponding pair of bores 12 formed into the bottom side 4 in upper stacking elements 1. The purpose of posts 11 and bores 12 is to prevent stacking elements 1 from sliding horizontally relative to one another when in a stacked configuration. Since each stacking element 1 contains both posts 11 and bores 12, many stacking elements 1 can be used together to create a stable system for stacking scaffold members. To prevent vertical displacement of stacking elements 1 relative to one another, U-shaped cleats 13 extend from either or both of opposing ends 5,6, through which cable 14 is passed and tightly secured. Cleats 13 are preferably constructed of a rust-resistant material, such as aluminum or stainless steel, and are embeddedly attached to block member 2 during the molding process. The uppermost layer of scaffold members may be held down either by wrapping a strap 15 around all of the scaffold members, or by placing additional stacking elements 1 on top of the scaffold members and tying it down with the lower stacking elements 1 using cleats 13 and cable 14.

Although the present invention has been described in terms of specific embodiments, it is anticipated that alterations and modifications thereof will no doubt become apparent to those skilled in the art. For instance, increasing the depth of recesses 9 along top side 3, and making bottom side 4 flat would clearly be an obvious alteration, but would result in a non-360° contact around the scaffold members. It is therefore intended that the following claims be interpreted as covering all such modifications as fall within the true spirit and scope of the invention.

I claim:

1. A scaffold stacking device for holding scaffold members, comprising:

(a) a block member having a top side and a bottom side;

(b) a plurality of recesses formed along said top side, wherein each of said recesses is sized to receive a scaffold member; and (c) a cleat attached to said block member; and (d) a cable attached to said cleat for connecting to a second cleat on a second scaffold stacking device.

2. The device according to claim 1, further comprising a second plurality of recesses formed along said bottom side, wherein each .of said recesses is sized to receive a scaffold member.

3. The device according to claim 2, wherein said recesses of said first and second plurality of recesses are equally spaced along said top side and said bottom side, respectively; and wherein each of said recesses has a semi-circular shape of a radius substantially equal to the radius of a scaffold member.

4. The device according to claim 3, wherein the depth of each of said recesses is substantially equal to the radius of a scaffold member.

5. The device according to claim 2, wherein said block member includes:

(a) a post extending upward from said top side; and (b) a bore formed in said bottom side sized to receive a second post extending from a second scaffold stacking device.

6. The device according to claim 1, wherein said block member includes:

(a) a post extending upward from said top side; and (b) a bore formed in said bottom side sized to receive a second post extending from a second scaffold stacking device.

7. The device according to claim 1, wherein said recesses are equally spaced along said top side, and wherein each of said recesses has a semi-circular shape of a radius substantially equal to the radius of a scaffold member.

8. The device according to claim 1, wherein the depth of each of said recesses is substantially equal to the radius of a scaffold member.

* * * * *